US006464153B1

(12) United States Patent
Bonnah, II et al.

(10) Patent No.: US 6,464,153 B1
(45) Date of Patent: Oct. 15, 2002

(54) FUEL INJECTOR HAVING A MOLDED SHROUD FORMED OF A STRUCTURAL ADHESIVE POLYMER

(75) Inventors: Harrie William Bonnah, II, Pittsford; Robert B. Perry, Leicester, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 25 days.

(21) Appl. No.: 09/689,105

(22) Filed: Oct. 12, 2000

(51) Int. Cl.[7] ..... F02M 51/00
(52) U.S. Cl. ..... 239/585.1; 123/472
(58) Field of Search ..... 239/585.1, 585.2, 239/585.5, 584; 123/470, 472; 251/129.21, 117

(56) References Cited

U.S. PATENT DOCUMENTS

| | | | | | |
|---|---|---|---|---|---|
| 5,065,128 | A | * | 11/1991 | Schmitt-Matzen | 335/299 |
| 5,083,747 | A | * | 1/1992 | Schmitt-Matzen | 251/129.21 |
| 5,102,095 | A | * | 4/1992 | Schmitt-Matzen et al. | 251/117 |
| 5,226,221 | A | * | 7/1993 | Kilgore | 29/605 |
| 5,381,965 | A | * | 1/1995 | Chabon et al. | 239/585.1 |
| 5,533,249 | A | * | 7/1996 | Wakeman | 29/605 |
| 5,580,086 | A | * | 12/1996 | McAlister | 280/737 |

* cited by examiner

*Primary Examiner*—Carl S. Miller
(74) *Attorney, Agent, or Firm*—Patrick M. Green

(57) ABSTRACT

The present invention is directed to a fuel injector for an internal combustion engine wherein components external to the tubular body are positioned, joined, and retained on the body, and wherein the tubular body is structurally reinforced, by being encapsulated together in a molded shroud formed of a structural adhesive polymer.

9 Claims, 5 Drawing Sheets

FUEL INJECTOR HAVING A MOLDED SHROUD FORMED OF A STRUCTURAL ADHESIVE POLYMER

TECHNICAL FIELD

The present invention relates to fuel injectors for injecting fuel into the fuel intake systems of internal combustion engines; more particularly, to a fuel injector having a plurality of components disposed on the outer surface of a thin tubular body; and most particularly to a fuel injector wherein the components external to the tubular body are encapsulated and held in proper functional relationships by a surrounding shroud formed of a structural adhesive polymer.

BACKGROUND OF THE INVENTION

Fuel injectors are well known components of internal combustion engines, being useful for repeated injection of metered amounts of liquid fuel into the fuel intake system. Typically, one fuel injector is provided for each cylinder of an engine, being mounted with entry into either the engine intake manifold or directly into the firing chamber. Each fuel injector includes a solenoid-operated poppet valve which receives an electrical signal coordinated with signals to all other injectors to dispense fuel in synchrony with the firing of the engine. The valve is opened by energizing of the electric solenoid and is closed by a mechanical coil spring.

In the known art, a fuel injector generally includes a central tubular body having connection to a fuel supply at one end and a valve seat at the other end. A valve head matable with the seat is attached to a solenoid slug, or core, which is slidably disposed within the tube to open and close the valve. The core is hollow and is ported above the valve head to permit fuel to be supplied axially through the core to the valve. A portion of the tube is surrounded by the electrical windings of a solenoid coil, and the core extends axially by a distance into the coil. Energizing the windings causes the core to move farther into the coil, thus opening the valve and injecting fuel into the engine. Typically, the windings are positioned and retained axially on the outer surface of the tube by an enclosing housing which is spot welded to the tubular body.

Several practical problems arise in optimizing the configuration and construction of such a fuel injector. Because the windings are outside the tubular body and a solenoid pole piece and core are inside, the body must be formed of a non-ferromagnetic material, such as a 300-series stainless steel. To maximize the strength of the axial magnetic field within the solenoid, the body wall is formed as thin as is structurally feasible, typically being 300–400 m thick. However, because the tubing is thin, the wall may be breached inadvertently during welding of components to it, resulting in a leaky and thus defective injector. Further, the tubular body must be sufficiently rugged to withstand the various forces of torque and shock which the injector must undergo during its assembly and working lifetime.

What is needed is a simple and cost-effective means for providing auxiliary structural support to the tubular body of a fuel injector, thus allowing further thinning of the body wall to increase the effective strength of the solenoid magnetic field; reducing the number of components to be manufactured, inventoried, and assembled; and also obviating the need for welding a windings housing to the body.

SUMMARY OF THE INVENTION

The present invention is directed to a fuel injector for an internal combustion engine wherein components external to the tubular body are positioned, joined, and retained on the body, and wherein the tubular body is structurally reinforced, by being encapsulated together in a molded shroud formed of a structural adhesive polymer.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 1:
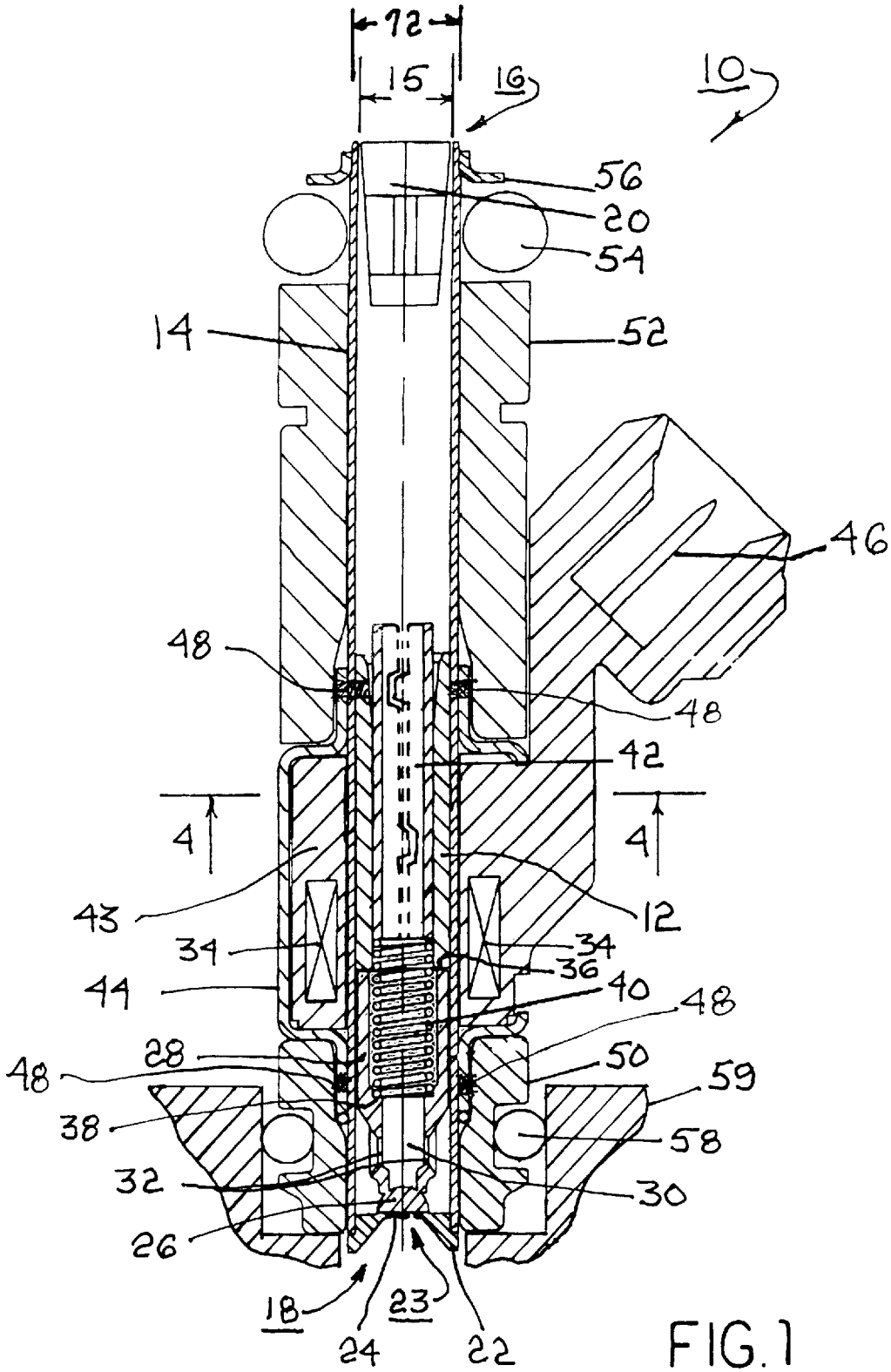
FIG. 1 (PRIOR ART)
FIG. 1 is a cross-sectional elevational view of a prior art fuel injector.

The benefits of the invention can be more fully appreciated by first examining the prior art fuel injector 10 shown in FIG. 1. Fuel injector 10 includes a longitudinal cylindrical body 14 having a central bore 15 containing a fixed pole piece 12 and having a fuel entrance end 16 and a fuel exit end 18. Body 14 is typically formed of a high quality, non-corroding steel, such as a 300 series stainless steel, and has walls about 300–400 m thick. A fuel filter 20 is disposed within bore 15 at the entrance end and a valve seat 22 of poppet valve 23 is attached as by welding to body 14 at the exit end. Seat 22 has a central aperture 24 which is sealingly matable with a poppet valve body 26 formed at an end of cylindrical core 28 which is slidably disposed within bore 15. Cylindrical core 28 and valve body 26 have a central bore 30 and radial passageways 32 between bores 30 and 15 for passage of fuel from entrance end 16 to valve 23.

Electrical solenoid windings 34 surround body 14 and are so placed axially of body 14 that core 28 extends a distance into the windings. Thus, when the solenoid is energized, valve body 26, being formed of a ferromagnetic material, is drawn axially further into the solenoid windings 34, opening valve 23. The axial stroke of valve body 26 is limited by the lower end 36 of pole piece 12, the pole piece being accurately positioned axially and secured within bore 15 to provide the desired length of stroke, typically, about 100 m. Pole piece 12 is a tube having walls 2–5 mm thick and formed of a magnetically soft material such as soft iron. As such, it acts as both a stop for the stroke of the valve body and a magnetic pole piece in the field created by windings 34 which assists in drawing the valve body into the windings.

Bore 30 is enlarged in diameter over a portion of its length to provide a step 38 for receiving one end of a return spring 40 for closing valve 23. The other end of spring 40 is arrested by a spring calibration sleeve 42, typically a cylindrical roll pin inserted into internal diameter 13 of pole piece 12. Because of inherent variability among springs, the axial position of sleeve 42 within internal diameter 13 may be adjusted during assembly of the injector to provide the desired performance response of the valve body.

Windings 34 are potted in a plastic matrix 43 enclosed by a metal housing 44 and are connected to an external electrical connector 46 (conventional internal connections not shown). Housing 44 is positioned axially on body 14 between a rigid lower spacer 50 and a rigid upper spacer 52, captured by a resilient spacer 54 (typically an O-ring) and a swaged retainer 56. A lower O-ring 58 on spacer 50 is a gas seal for the injector against the engine 59 into which it is installed. Housing 44 is connected to tube 14, for example, as by welds 48, to retain the windings at the proper axial position along tube 14, and to form a return path for closure of the magnetic field induced by electrification of windings 34.

As described above, a serious problem in manufacturing prior art fuel injectors is that the very thin wall of the injector body is easily damaged or breached during the spot welding of the windings housing; yet, the housing and windings must be accurately and reliably positioned and retained in the correct axial position along the body over the working life of the injector.

Referring to FIGS. 2 through 6, an improved fuel injector 60 in accordance with the invention is for use as a direct substitute for injector 10. Fuel injector 60 utilizes a structural polymeric shroud 62 to reinforce tubular body 14, permitting thereby advantageous thinning of the tube wall, reduction in the number of components required external to the tubular body, and eliminating the need to weld housing 44 to body 14. Shroud 62 is formed of a structural adhesive, for example, an epoxide, urethane, phenolic, or rubber polymer which can bond to the metal parts it enshrouds. Non-adhesive polymers such as nylon or polyolefins, although structurally competent, are not suitable because the windings may unacceptably slide or rotate along the body during the lifetime of the injector, causing impairment of the injector function. Further, non-adhesive polymers cannot seal out external agents, such as road salt, which can undesirably enter and degrade plastic/metal contacts.

Figure 2:
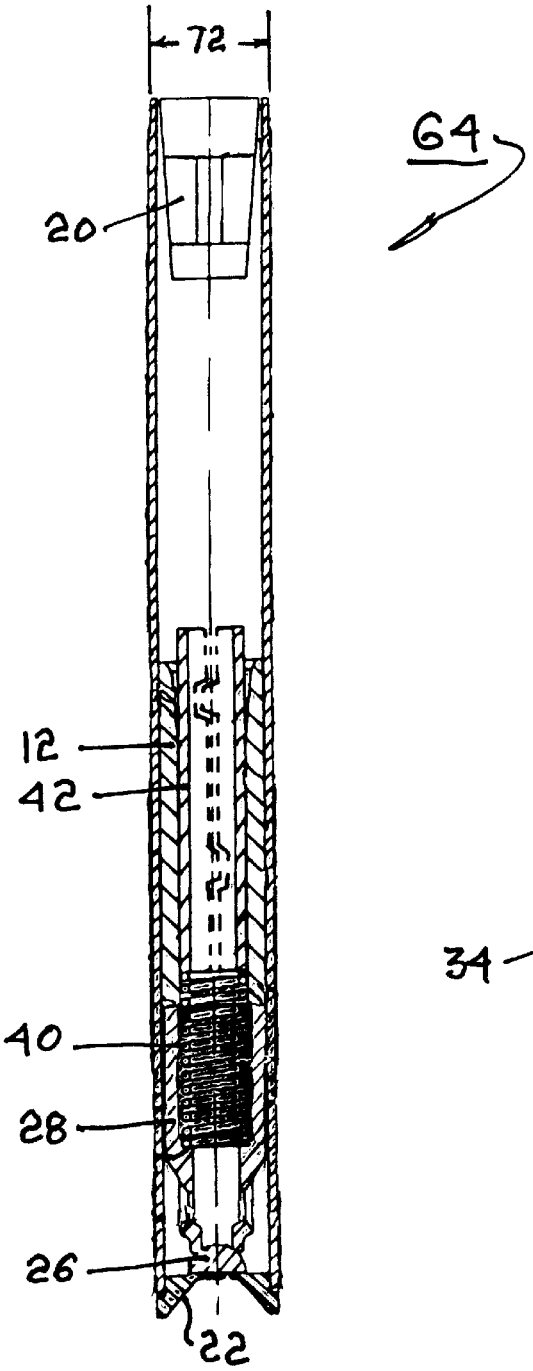
FIG. 2 is a cross-sectional elevational view of a fuel injector tube and internal components in accordance with the invention.
Figure 3:
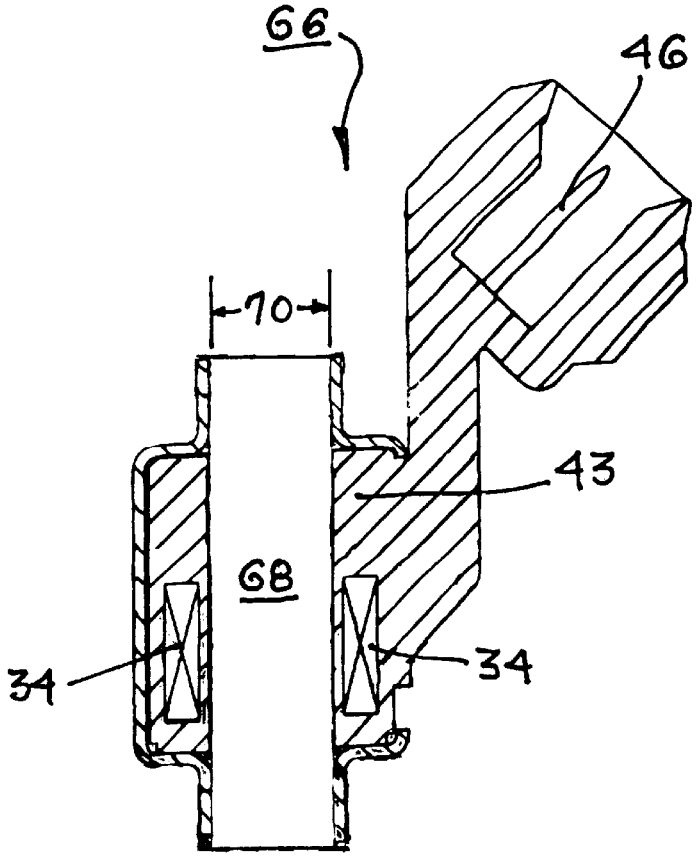
FIG. 3 is a cross-sectional view of an overmolded subassembly of a solenoid coil and connector for use in accordance with the invention.
Figure 4:
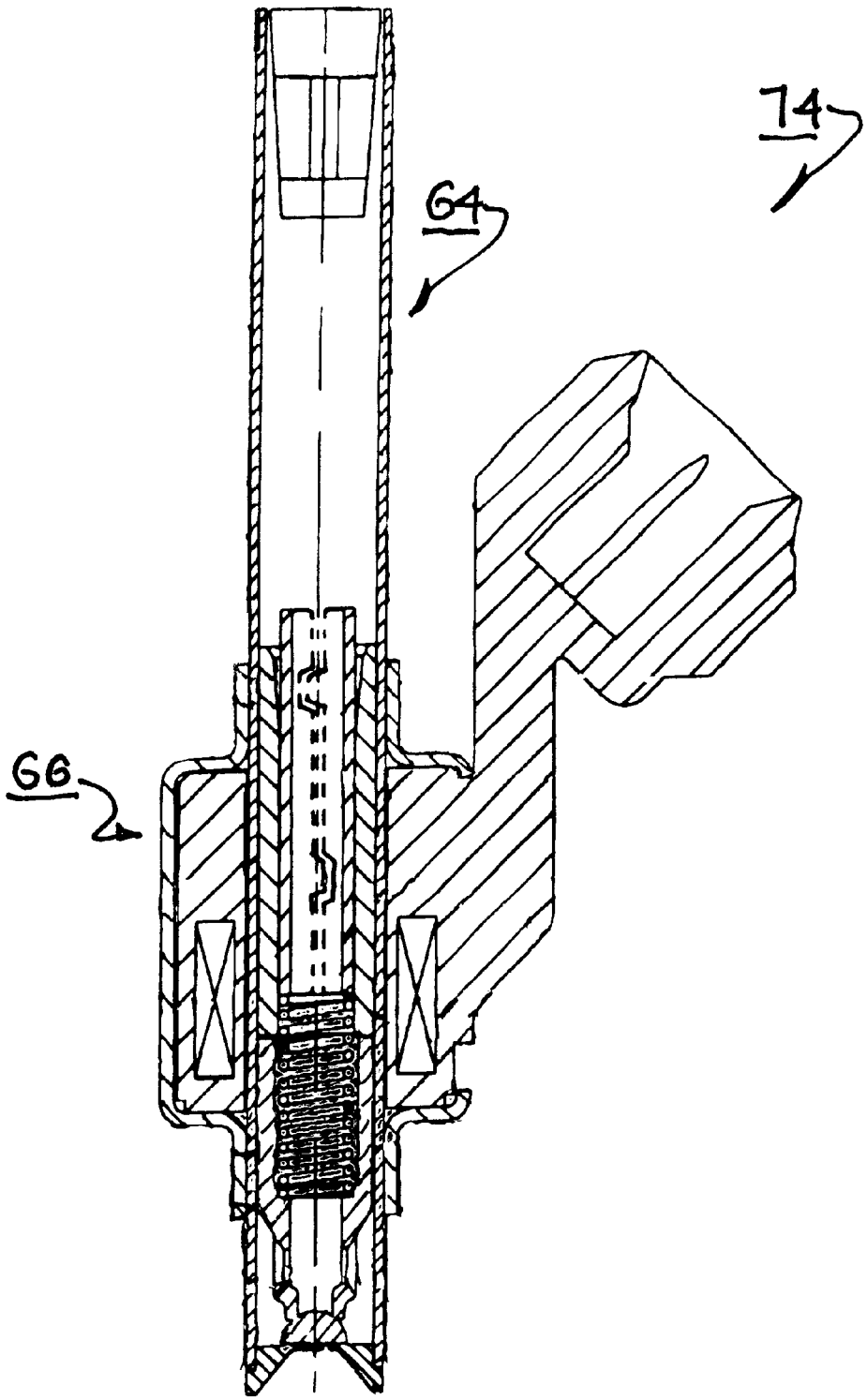
FIG. 4 is a cross-sectional view of a fuel injector assembly ready for insertion into a mold, showing assembly of the components shown in FIGS. 2 and 3.
Figure 5:
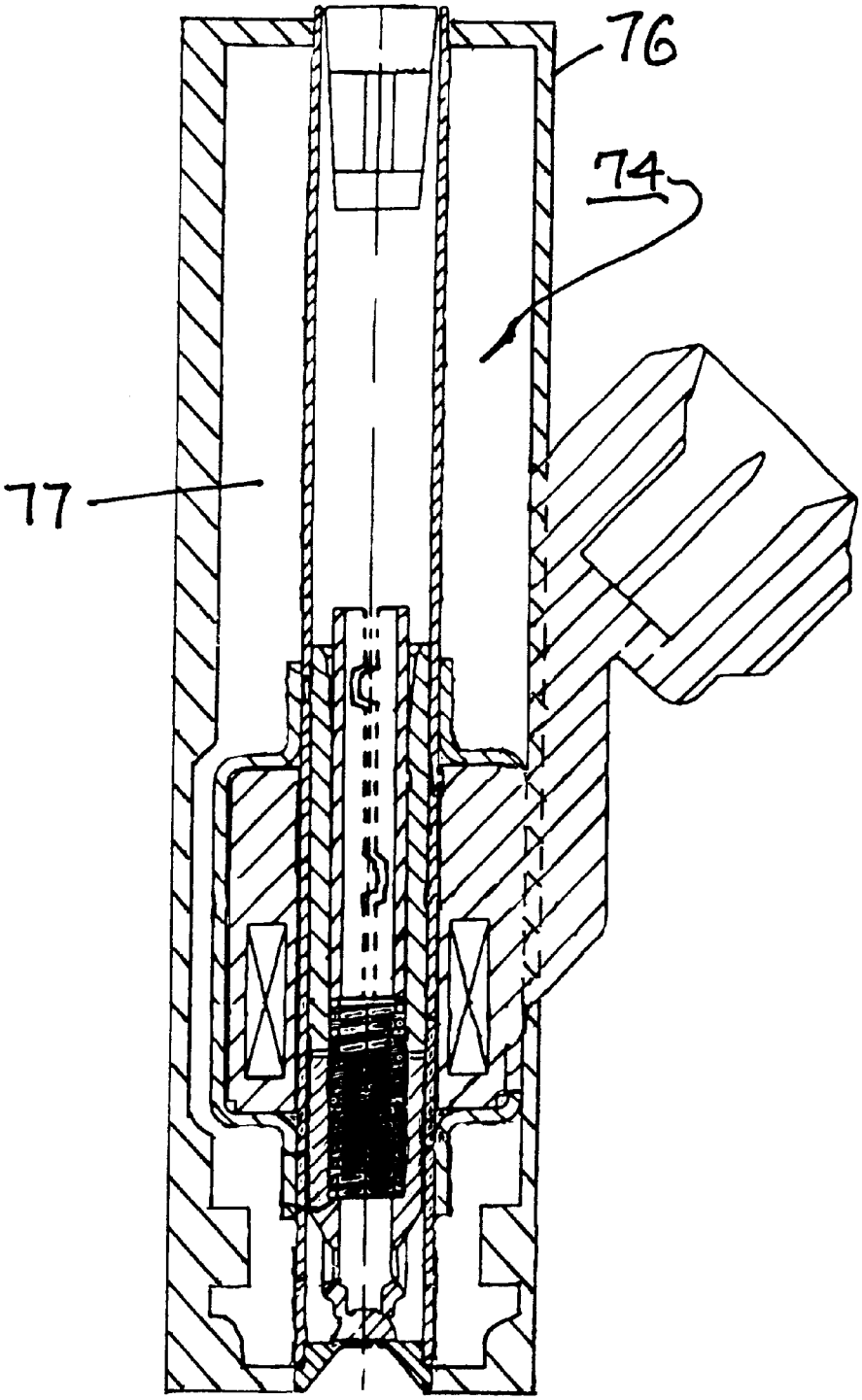
FIG. 5 is a cross-sectional view of the assembly shown in FIG. 4 after insertion into a mold and ready for overmolding of an encapsulating shroud in accordance with the invention.
Figure 6:
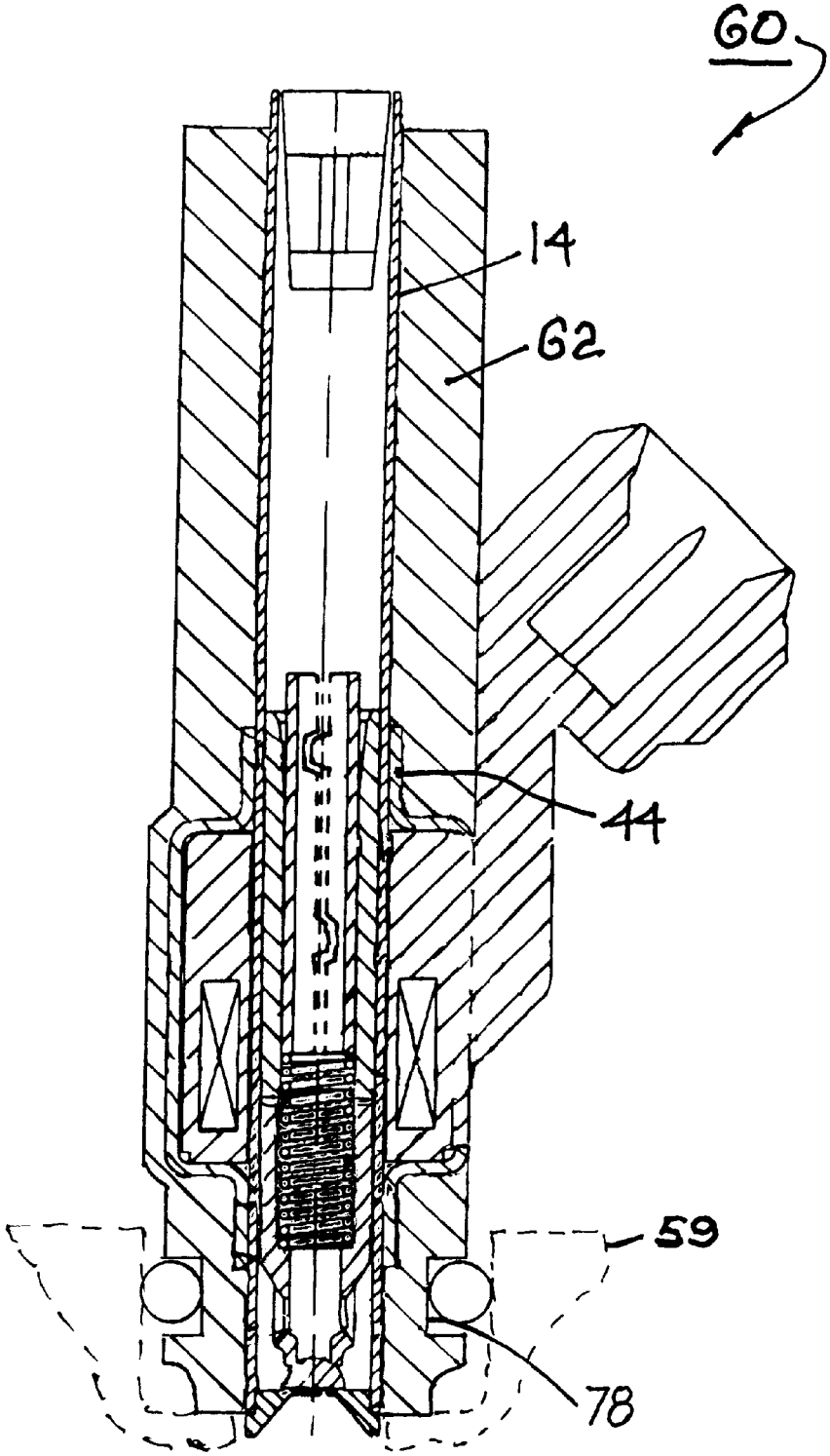
FIG. 6 is a cross-sectional view of a fuel injector after removal from the mold shown in FIG. 5.

An improved fuel injector 60 in accordance with the invention is readily formed by insertion molding of shroud 62 as follows. As shown in FIG. 2, an injector body mechanical sub-assembly 64 is substantially the same as is shown in prior art injector 10 in FIG. 1, that is, all components internal to body 14 in injector 10 are the same in sub-assembly 64, although the wall thickness of body 14 may be substantially less than the prior art wall thickness of 300–400 m cited above. FIG. 3 shows an electrical sub-assembly 66 including solenoid windings 34 and an electrical connector 46 cast in a plastic matrix 43 in known fashion in a previous step unrelated to the present invention. Sub-assembly 66 has an axial bore 68 therethrough of a diameter 70 substantially identical with the outer diameter 72 of body 14 such that the electrical sub-assembly 66 may be slip fit over the mechanical sub-assembly 64 and moved along body 14 to a predetermined axial location, as shown in FIG. 4, to yield a fuel injector mechanical assembly 74 ready for molding. A conventional separable injection mold 76 is provided for receiving assembly 74, as shown in FIG. 5, providing a chamber 77 surrounding assembly 74 in the shape of shroud 62 for receiving an injection of a liquid structural adhesive polymer. After such injection and curing to solidify as is well known in the art, mold 76 is removed to yield improved fuel injector 60, shown in FIG. 6. Preferably, the injection molded shroud 62 obviates the need for prior art components lower spacer 50, upper spacer 52, resilient spacer 54, and retainer 56, at a great savings in parts manufacture and inventory, as well as obviating the need for welds 48 and broadly distributing loads imposed on the injector body 14. Of course, these components, or others as may be needed, may be included in a properly configured mold and encapsulated within the shroud, as may be desired, within the scope of the invention. Shroud 62 preferably includes a circumferential recess 78 for receiving lower O-ring 58 as in the prior art.

The foregoing description of the invention, including a preferred embodiment thereof, has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A fuel injector, comprising:

a mechanical subassembly having an elongate injector body, a poppet valve seat disposed at an end of said injector body and a poppet valve body matable with said valve seat and axially slidable within said injector body;

an electrical subassembly having a housing, said housing defining a bore therethrough, a solenoid winding disposed within said housing, and a connector extending from said housing, said injector body being received within said bore with a slip fit, a portion of said injector body disposed within said bore; and an encapsulating shroud attached to and substantially completely surrounding said injector body and said housing, said shroud securing together in a predetermined relative axial position said electrical and mechanical subassemblies, said shroud comprising a structural adhesive polymer.

2. The fuel injector of claim 1, wherein said injector body is substantially cylindrical, said injector body having an outside diameter, said bore of said housing having an inside diameter, said outside diameter being one of a predetermined amount less than and substantially equal to said inside diameter.

3. The fuel injector of claim 1, wherein said elongate injector body includes a wall, said wall having a thickness of less than 300 micrometers ($\mu$m).

4. The fuel injector of claim 3, wherein said wall has a thickness of less than 200 micrometers ($\mu$m).

5. The fuel injector of claim 1, wherein said shroud is injection molded onto and around said injector body and said housing.

6. A method for making a fuel injector, comprising:

inserting an injector body of a mechanical subassembly into a housing of an electrical subassembly;

relatively sliding said mechanical subassembly and said electrical subassembly into a predetermined relative axial position;

coupling together and reinforcing said mechanical subassembly and said electrical subassembly in said predetermined axial position with a shroud of structural adhesive polymer molded to said mechanical subassembly and said electrical subassembly.

7. The method for making a fuel injector of claim 6, wherein said adhesive polymer is selected from the group consisting of epoxsides, urethanes, phenolics, and rubbers.

8. The method for making a fuel injector of claim 6, wherein said injector body includes a wall, said wall having a thickness of less than 300 micrometers ($\mu$m).

9. A fuel injector in accordance with claim 1, wherein said structural adhesive polymer is selected from the group consisting of epoxides, urethanes, phenolics, and rubbers.

* * * * *